US006543584B1

(12) United States Patent
Miyakoshi et al.

(10) Patent No.: US 6,543,584 B1
(45) Date of Patent: Apr. 8, 2003

(54) ELEVATOR WITH ADJUSTABLE TOP EDGE RAILING MEMBERS

(75) Inventors: Kazuaki Miyakoshi, Kanagawa-ken (JP); Kosei Kamimura, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/389,473

(22) Filed: Sep. 3, 1999

(30) Foreign Application Priority Data

Sep. 3, 1998 (JP) ..... 10-249873
Oct. 9, 1998 (JP) ..... 10-287843

(51) Int. Cl.[7] ..... B66B 5/00; B66B 9/04; B66B 11/02

(52) U.S. Cl. ..... 187/401; 182/113; 256/65.14

(58) Field of Search ..... 187/401, 414, 187/250, 313, 244; 182/113, 152; 256/1, 59, 65.01, 65.14, 67

(56) References Cited

U.S. PATENT DOCUMENTS 3,878,916 A * 4/1975 White, Jr. ..... 187/250
5,121,812 A * 6/1992 Ochiai et al. ..... 182/152

FOREIGN PATENT DOCUMENTS

| | | |
|---|---|---|
| JP | 401281281 | * 11/1989 |
| JP | 403120183 | * 5/1991 |
| JP | 404292386 | * 10/1992 |
| JP | 405330752 | * 12/1993 |
| JP | 406032555 | * 2/1994 |
| JP | 408113440 | * 5/1996 |
| JP | 408133617 | * 5/1996 |
| JP | 2001058774 | * 3/2001 |
| JP | 2002003113 | * 1/2002 |
| JP | 2002020062 | * 1/2002 |

* cited by examiner

*Primary Examiner*—Eileen D. Lillis
*Assistant Examiner*—Paul T. Chin
(74) *Attorney, Agent, or Firm*—Oblon, Spivak, McClelland, Maier & Neustadt, P.C.

(57) ABSTRACT

An elevator including a cage configured to ascend and descend in an elevator shaft, and at least one railing member disposed along at top edge of the cage and configured to be adjustable in height so that during performance of maintenance by a maintenance person, the railing is adjusted to be in an upright position, and is otherwise maintained in a position lower than a highest protruding object existing on the top of the cage.

10 Claims, 13 Drawing Sheets

ELEVATOR WITH ADJUSTABLE TOP EDGE RAILING MEMBERS

CROSS REFERENCE TO RELATED APPLICATION

This application claims benefit of priority to Japanese Patent Applications No. JP10-249873 filed Sep. 3, 1998 and No. JP10-287843 filed Oct. 9, 1998, the entire contents of which are incorporated by reference herein.

BACKGROUND OF THE INVENTION

1. Field of the Invention

The present invention relates to an elevator with improved railings provided on an upper side of a passenger cage along the top edges thereof.

2. Discussion of the Background

In general, elevators have been installed in a high rise building so that residents or the like can easily get to the desired upper or lower floors.

The conventional elevator, as shown in FIG. 1, is operated in an elevator shaft 1 extending vertically in the building, and includes a pair of guide rails 2 installed in the shaft 1, a cage 4 movably supported between the guide rails 2 via a cage frame 3, and a drive system 5 moving the cage 4 up and down. The drive system 5 is composed of cables (only one is shown) 6, two car sheaves 7, a counter weight sheave 8, a counter weight 9, and a hoisting machine 10 disposed in the upper part of the shaft 1 for driving the cables 6.

In this type of elevator where the hoisting machine 10 is disposed in the upper part of the shaft 1, thereby dispensing with a machine room located right above the shaft 1 in which a hoisting machine, a control panel and the like is conventionally installed, it is especially required to reduce the overhead measurements at the installation of the elevator so that the building space other than the shaft 1 can be used effectively. (The overhead measurements refer to a distance between a floor of the cage 4 and a ceiling of the shaft 1 at the time the cage 4 stops at the upper most floor.)

Practically speaking, the overhead measurements are determined by a distance between the highest object on the cage 4, that is guide shoes 11, and the lowest object on the ceiling part of the shaft 1, that is the ceiling of the shaft 1. Further, the distance from the highest object on the cage 4 to the lowest object on the ceiling of the shaft 1 can be affected by conditions of other components in the shaft 1 such as a stroke of a counter weight oil buffer (not shown), or a distance between the counter weight oil buffer and the counter weight 8.

Thus, to realize an elevator with small overhead measurements, it is necessary to reduce a distance between the highest object on the cage 4 and the ceiling of the shaft 1.

Furthermore, elevators are required to be inspected periodically, and on such occasions, maintenance workers sometimes inspect the elevators riding on the upper side of the cage 4. To ensure the safety of the maintenance workers, in general, railings 12 are provided on the upper side of the cage 4 along the side edges and back edge thereof. To realize an elevator with small overhead measurements, the height Y of railings 12 has to be lower than the height X of the highest object on the cage 4, i.e. the guide shoe 11.

However, if the height Y is lower than the height X, the railings 12 do not achieve the main object of ensuring the safety of the maintenance workers on the cage 4. On the other hand, if the height Y of the railings 12 becomes higher, the overhead measurements become longer, and as a result, it becomes impossible to realize an elevator with small overhead measurements.

SUMMARY OF THE INVENTION

Accordingly, one object of the present invention is to provide a novel elevator with small overhead measurements and which can ensure the safety of maintenance workers on the cage during an inspection by means of railings.

This and other objects are achieved according to the present invention by providing a new and improved elevator including a cage configured to ascend and descend in an elevator shaft, and a railing member disposed on the cage along a top edge thereof and configured to be adjustable in height.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 12(*b*) is a perspective view of the principal part of the railing member in FIG. 12(*a*);

FIG. 13(*b*) is a front view of the railing member in FIG. 13(*a*);

FIG. 15(*b*) is a front view of the railing member in FIG. 15(*a*);

DESCRIPTION OF THE PREFERRED EMBODIMENTS

Figure 3:
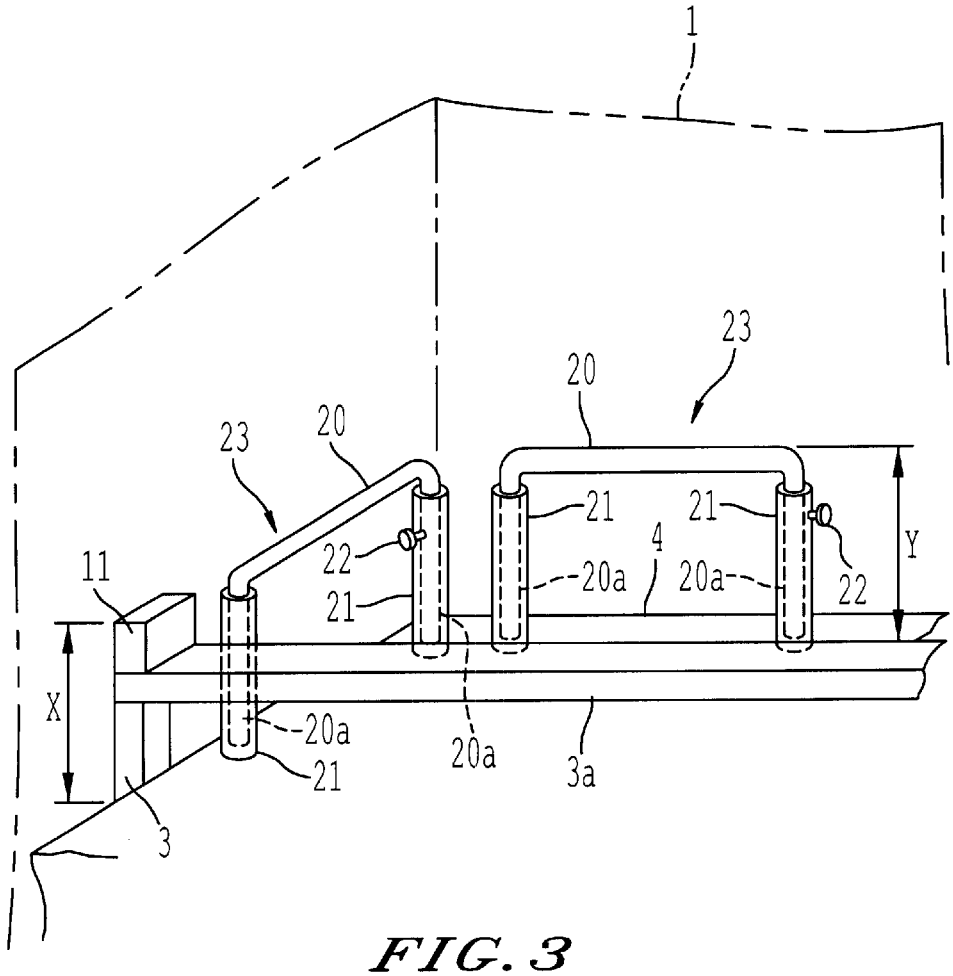
FIG. 3 is a perspective view showing railing members of a first embodiment of the present invention in a contracted state.
Figure 4:
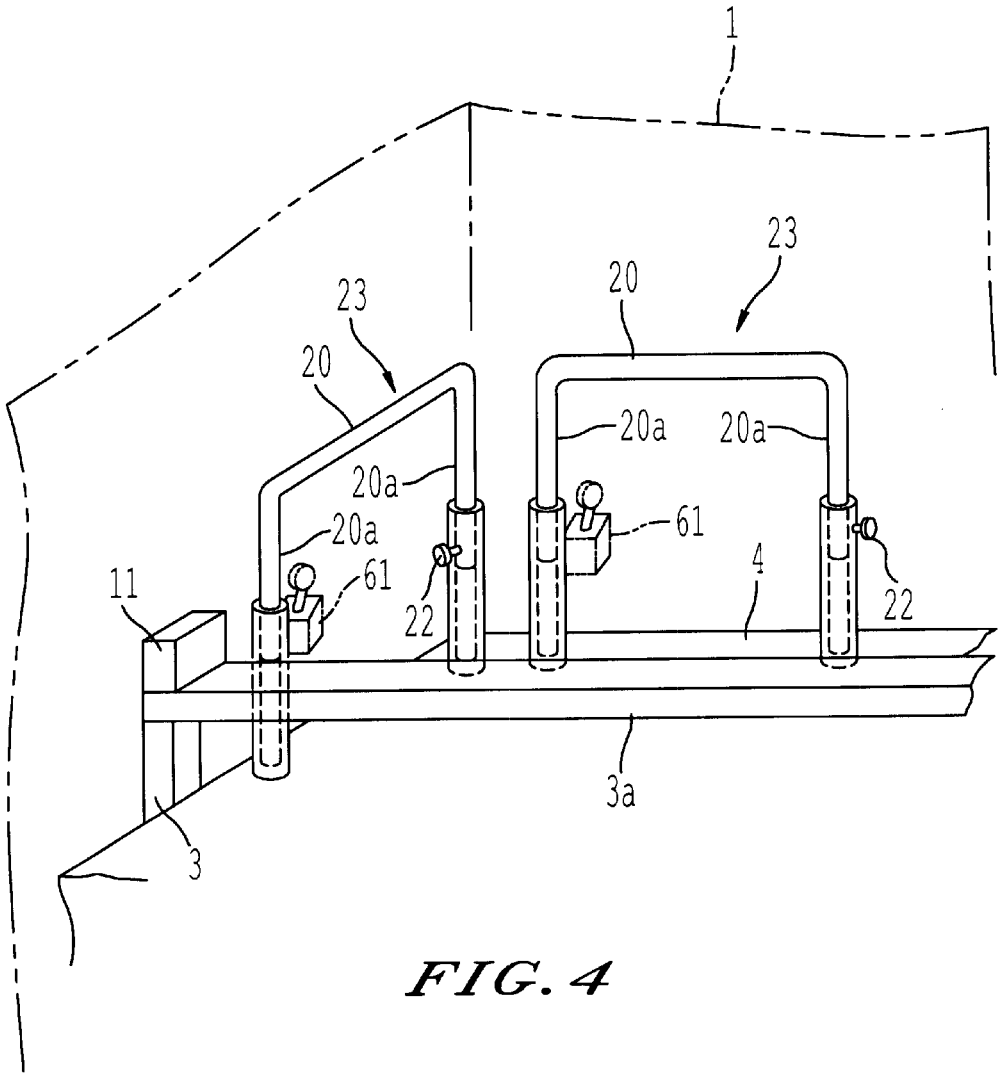
FIG. 4 is another perspective view showing railing members of the first embodiment of the present invention in an expanded state.

Referring now to the drawings, where like reference numerals designate the same or corresponding parts throughout the several views, next described is a first embodiment of the present invention shown in FIG. 3 and FIG. 4.

Figure 1:
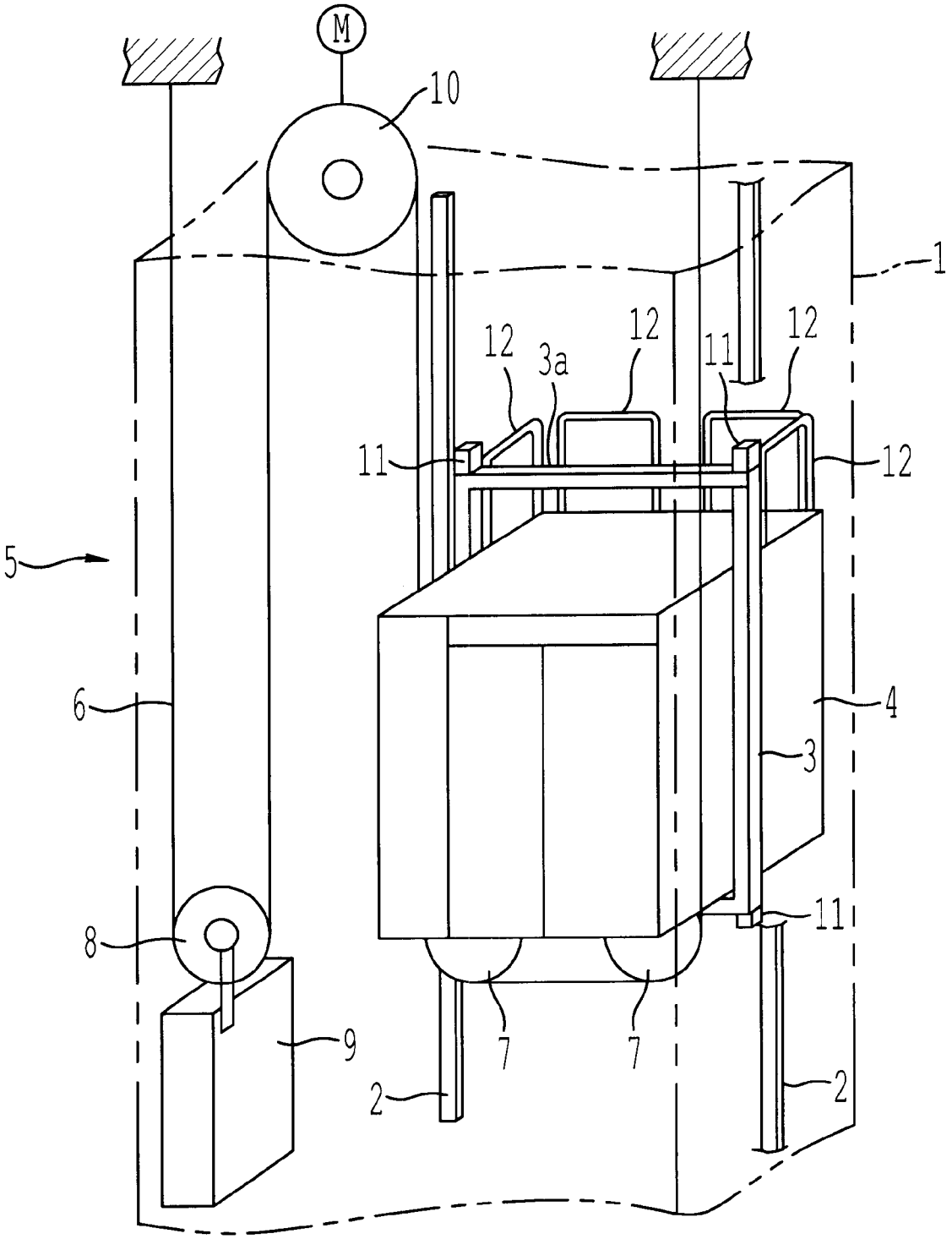
FIG. 1 BACKGROUND ART
FIG. 1 is a schematic perspective view showing a conventional traction type elevator.
Figure 2:
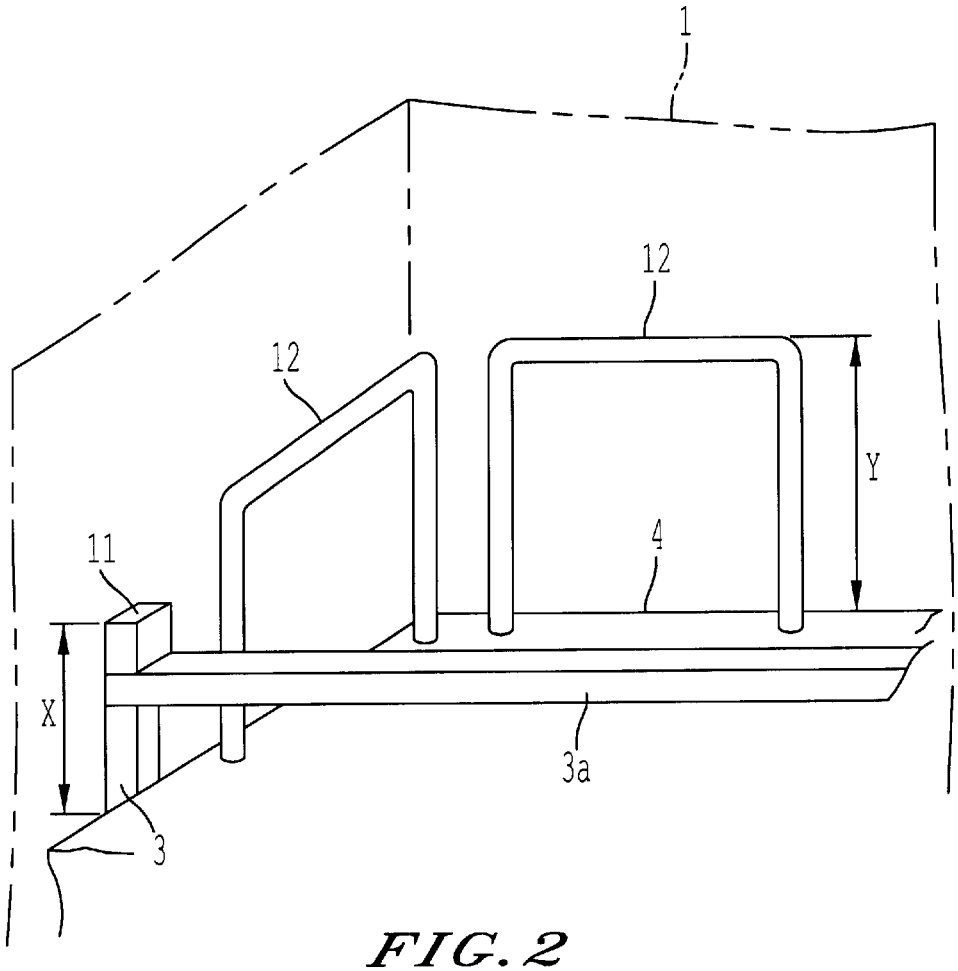
FIG. 2 BACKGROUND ART
FIG. 2 is a perspective view of railings in FIG. 1.

In this embodiment, since every component of the elevator other than railings 12 in FIG. 1 is the same structure as FIG. 1, there will be described only components of improved railings.

As shown in FIGS. 3 and 4, the railing members 23 are respectively formed in the shape of an inverted U and disposed at intervals on a cage 4 along the top side edges and the top back edge thereof. In FIG. 3, the railing member 23 disposed on the right side edge of the cage 4 is not shown, but only the railing members 23 disposed on the left side and the back side of the cage 4 are shown.

The railing members 23 are installed on the upper surface of the cage 4 so as to expand and contract vertically.

Each of the railing members 23 is composed of a pair of cylindrical pipes 21 standing on the cage 4 and a railing 20 having a pair of legs 20*a* movably inserted in the pipes 21 and extending from the upper ends thereof. The railing 20 is adjustable in height by inserting the legs 20*a* into the pipes 21 as shown in FIG. 3 and pulling the legs 20*a* out of the pipes 21 as shown in FIG. 4. The height of each pipe 21 is set such that the height Y of the railing 20 at the time the legs 20*a* are entirely inserted the pipes 21 becomes lower than the height X of the highest protruded object on the cage 4, typically the height of guide shoe 11, for example. Thus, the railing 20 is contracted to a position lower than the height X of the highest protruded object on the cage 4 at the time of normal operation of the elevator, and expanded to a higher position to ensure the safety of a maintenance worker at the time of inspection of the elevator.

Further, a lock device such as a bolt 22 heading to the inside of the pipe 21 is screwed on one of the upper end surfaces of the pair of pipes 21 in order to lock the expanded railing 20 at a position ensuring the safety of a maintenance worker by pushing the legs 20*a* with a head of the bolt 22.

According to the railing members 23 described above, since the legs 20*a* are entirely put into the pipes 21 as shown in FIG. 3 and the railings 20 is collapsed at the time of a normal operation of the elevator, the elevator can be installed in a building without increasing the overhead measurements.

Further, in case that a maintenance worker is inspecting the elevator riding on the cage 4, since the legs 20*a* are pulled out of the pipes 21 and locked at a high position ensuring the safety of the maintenance worker by screwing the bolt 22, the maintenance work can be performed securely.

Thus, the first embodiment can both reduce the over head measurements and ensure safety. Moreover, in the first embodiment, since the sliding railing members 23 are adopted, it is easy to design a railing height surely ensuring the safety of the maintenance worker by increasing the number of tiers of telescoping railings.

Figure 5:
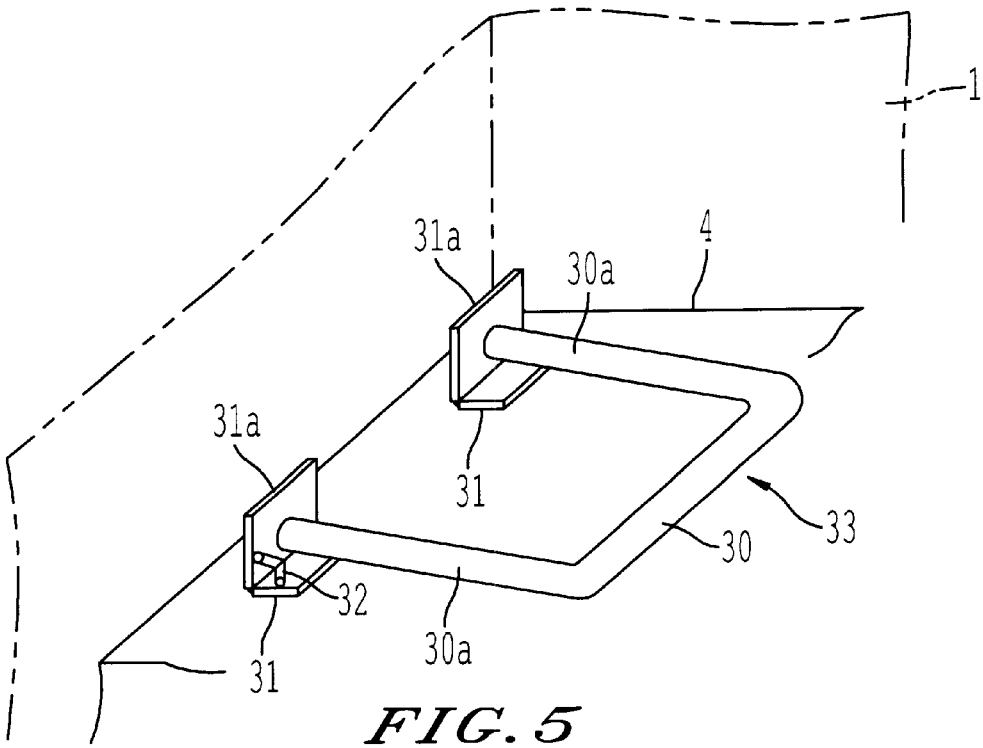
FIG. 5 is a perspective view of railing member of a second embodiment of the present invention in a collapsed state.
Figure 6:
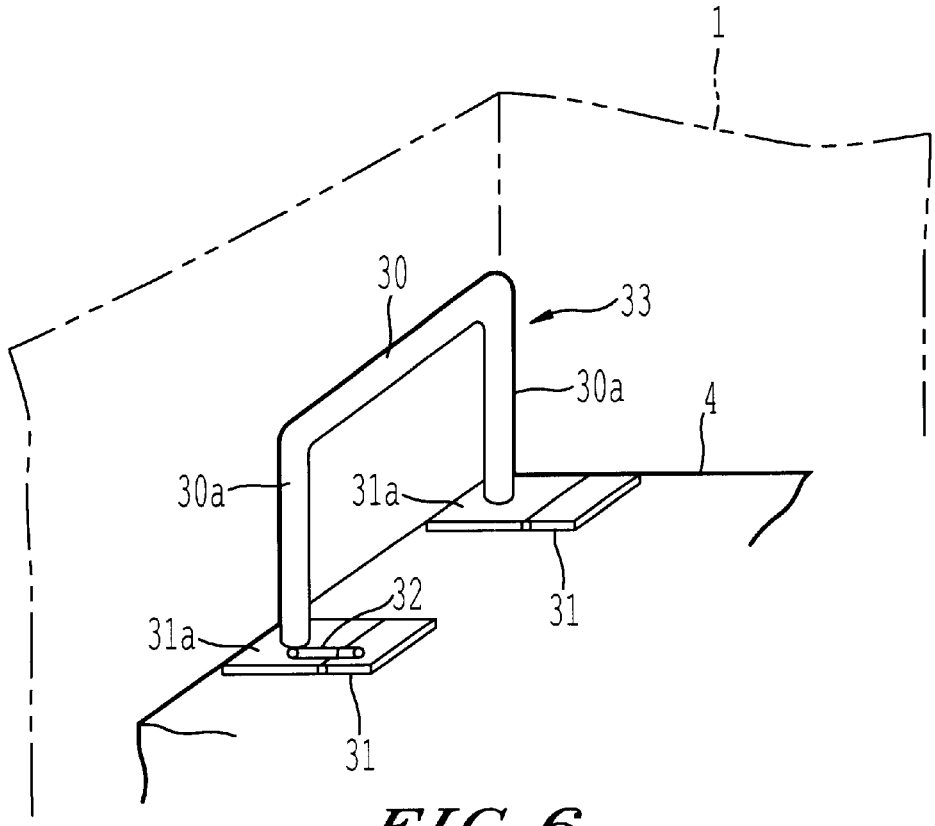
FIG. 6 is a perspective view of railing member of a second embodiment of the present invention in an upright state.

FIG. 5 and FIG. 6 are perspective views of railing members 33 of a second embodiment of the present invention, in which folding railing members are employed instead of sliding telescoping railings. The railing members 33 are disposed on the cage 4 along the top side edges and the top back edge thereof. In FIGS. 5 and 6, only the railing member 33 disposed on the left side of the cage 4 is shown. The railing members 33 disposed on the right side edge and the back side edge of the cage 4 are not shown for the sake of convenience.

Each of the railing members 33 is composed of a pair of hinge plates 31 mounted on the cage 4 so as to fold a railing 30 toward the center of the cage 4. The railing 30 has a pair of legs 30*a* which when upright have sufficient height to ensure the safety of a maintenance worker and are respectively secured to turning plates 31*a* of the hinge plates 31. In case of a normal operation of the elevator, as shown in FIG. 5, the railing 30 is folded down to the center of the cage 4 to a position lower than the height of the highest object on the cage 4. When the maintenance worker inspects the elevator while riding on the cage 4, the railing 30 is unfolded to the upright state as shown in FIG. 6 with enough height to ensure the safety of the maintenance worker. Further, a lock link 32 is attached to one of the hinge plates 31 in order to maintain the upright state of the railing 30, so that the railing 30 does not fold from the upright state to the folded state as long as the lock is not released.

According to the railing members 33 described above, the same effects as the first embodiment can be achieved. Moreover, folding railings of the second embodiment potentially offer the advantage of increased upright height of the railings, depending on the width and depth of the cage 4.

Figure 7:
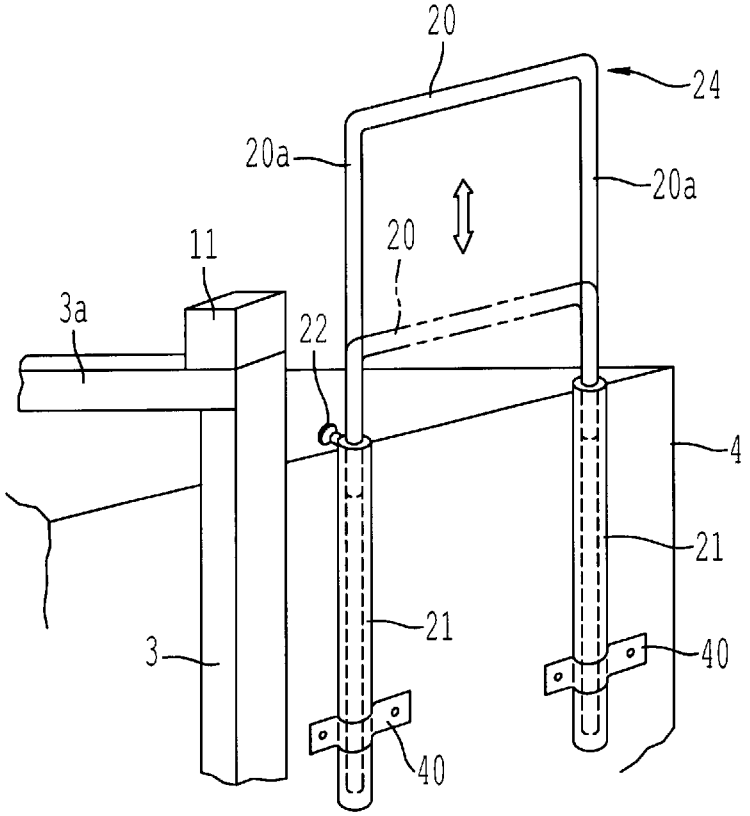
FIG. 7 is a perspective view of one railing member of a third embodiment of the present invention.

FIG. 7 is a perspective view of one railing member of a third embodiment of the present invention, in which the railing members 23 in the first embodiment shown in FIG. 3 are modified.

The railing members 24 of FIG. 7 are respectively formed in the shape of an inverted U and disposed at intervals along the top side edges and the top back edge of the cage 4 in the same way as the first embodiment in FIG. 3. In FIG. 7, only the railing member 24 disposed on the right side edge of the cage 4 is shown. In this embodiment, the railing members 24 are installed on side surface of the cage 4 so as to expand and contract vertically.

Each of the railing members 24 is composed of a pair of cylindrical pipes 21 standing on the side of the cage 4 and a railing 20 having a pair of legs 20*a* movably inserted in the pipes 21 from the upper ends thereof. The railing 20 is adjustable in height by putting the legs 20*a* into the pipes 21 as shown in FIG. 7 and pulling the legs 20*a* out of the pipes 21. The pipes 21 are secured on the side of the cage 4 with securing members 40.

Further, a lock device such as a bolt 22 heading to the inside of the pipe 21 is screwed on one of the upper end surfaces of the pair of pipes 21 in order to lock the expanded railing 20 at a position ensuring the safety of a maintenance worker by pushing the legs 20*a* with a head of the bolt 22.

According to the third embodiment, pipes 21 of relatively long length can be employed whereby railings 20 of sufficient height can easily be implemented.

Figure 8:
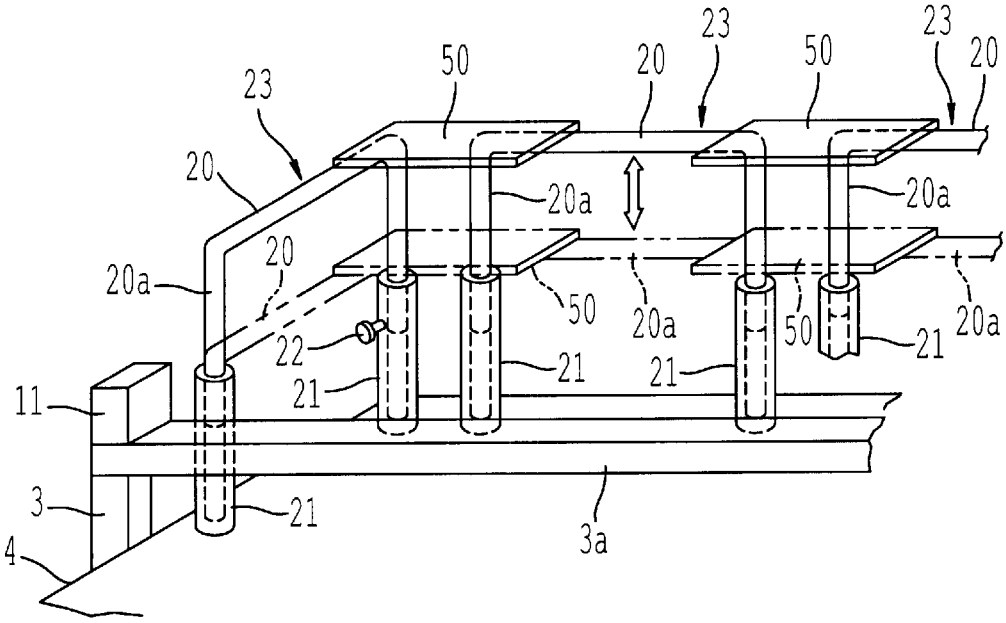
FIG. 8 is a perspective view of railing members of a fourth embodiment of the present invention.

FIG. 8 is a perspective view of railing members of a fourth embodiment of the present invention. The fourth embodiment modifies the first embodiment shown in FIG. 3, by adding connecting plates 50 to the components of the first embodiment.

In the fourth embodiment, the adjacent railings 20 are integrated at the upper portion thereof with one of the connecting plates 50 so that all of the railings 20 can simultaneously be returned to the folding state at the time of changing the elevator from an inspection state to a normal operation state. Thus, all railing members 23 can be moved up and down by operating one of the railings 20.

According to the fourth embodiment, the railing members 23 can be prevented from colliding with the ceiling of the shaft 1 after returning the elevator to the normal operation state.

Figure 9:
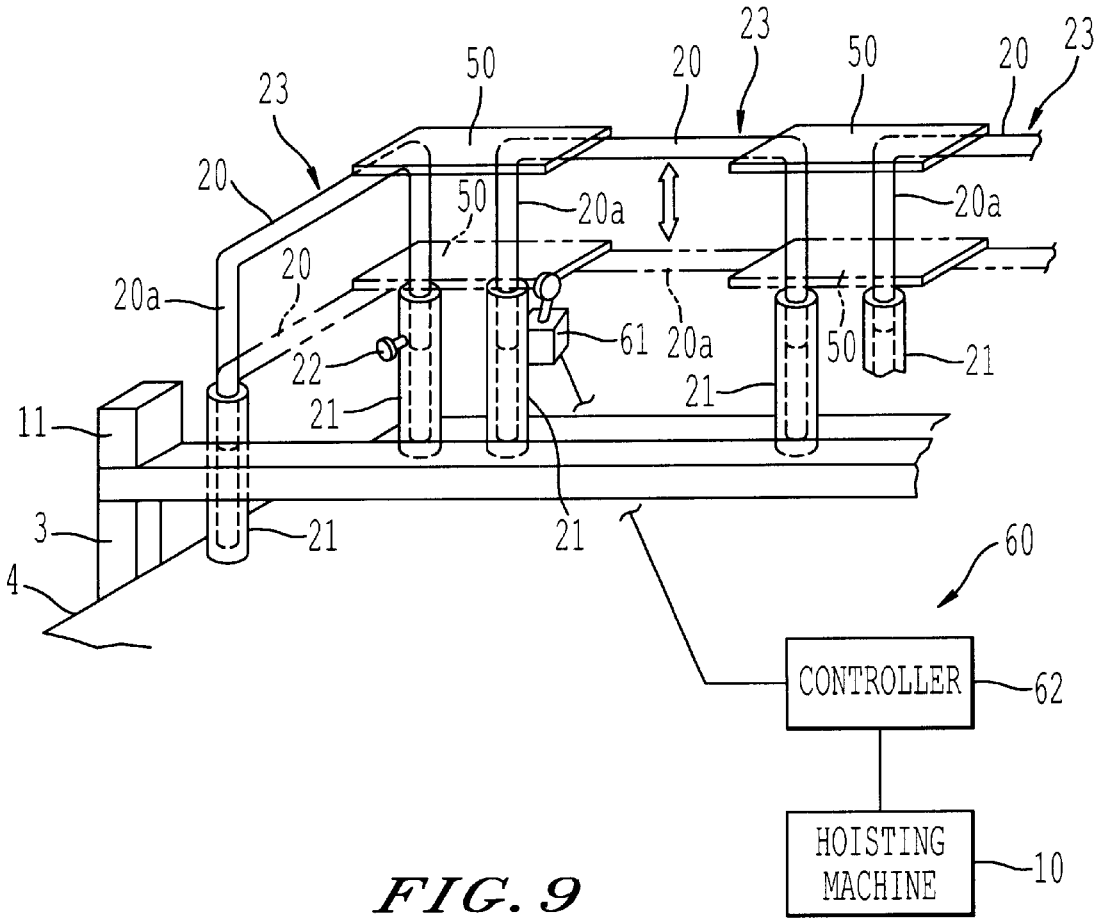
FIG. 9 is a perspective view of railing members of a fifth embodiment of the present invention.

FIG. 9 is a perspective view of railing members of a fifth embodiment of the present invention, in which an operation prohibiting device 60, which prohibits a normal operation of the elevator until the railings 20 return to a position lower than the highest object on the cage 4, is added to the fourth embodiment.

The operation prohibiting device 60 is composed of a limit switch 61 which detects whether the railings 20 return to a proper position, and a controller 62. The limit switch 61 outputs a confirmation signal to the controller 62 at the time the railings 20 return to a proper position for a normal operation of the elevator. The controller 62 outputs a permit signal to the hoisting machine 10 to allow a normal operation of the elevator only upon receiving the confirmation signal in order. That is, the elevator can not be operated until the railings 20 return to a position lower than the highest object on the cage 4, i.e. the guide shoe 11.

According to the fifth embodiment, even if it is attempted to operate the elevator in a normal operation is prevented, that is, the railings 20 remain higher than the guide shoe 11, the normal operation is prevented, so that the safety of the elevator can be improved.

This operation prohibiting device 60 can be employed with railing members individually installed on the cage 4 as described in the first embodiment, the second embodiment or the third embodiment. In this case, as shown with a double dotted chain line in FIG. 4, plural limit switches 61 are attached to respective of the railing members 23.

Figure 10:
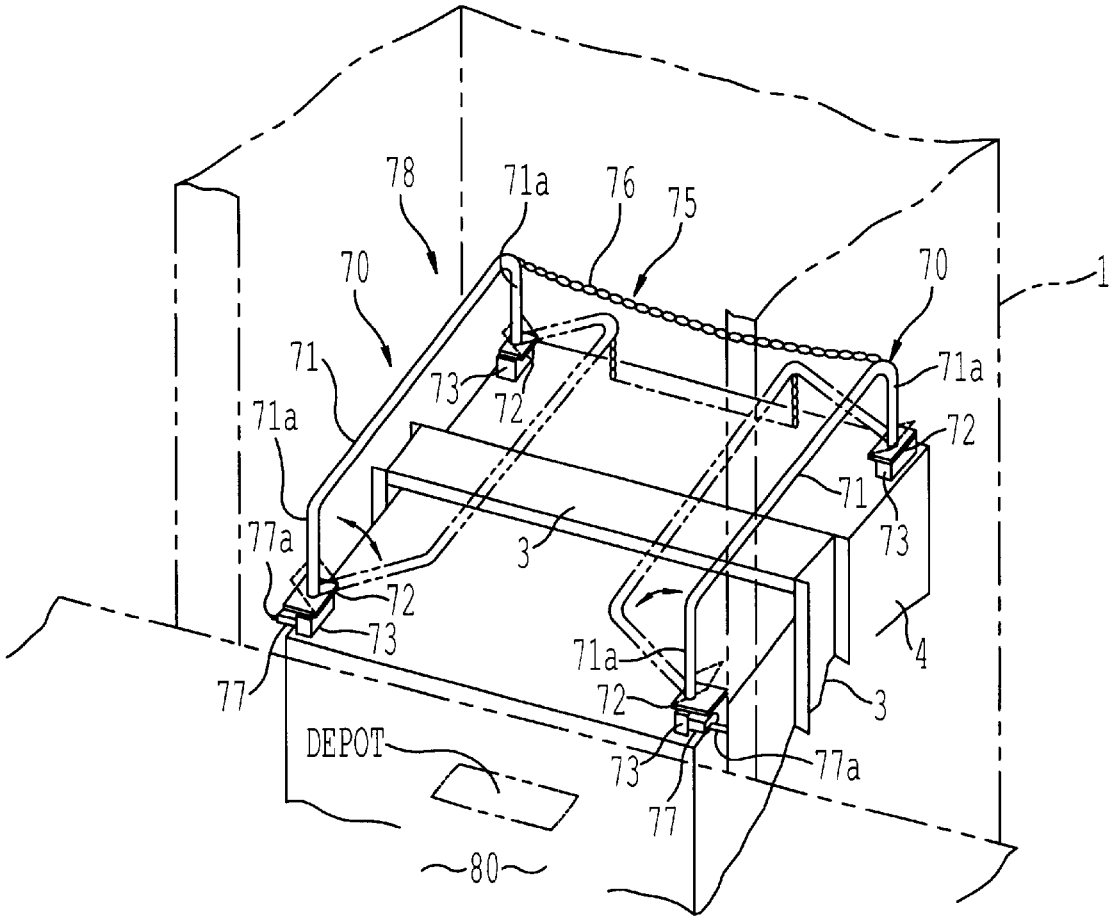
FIG. 10 is a perspective view of a railing member of a sixth embodiment of the present invention.
Figure 11:
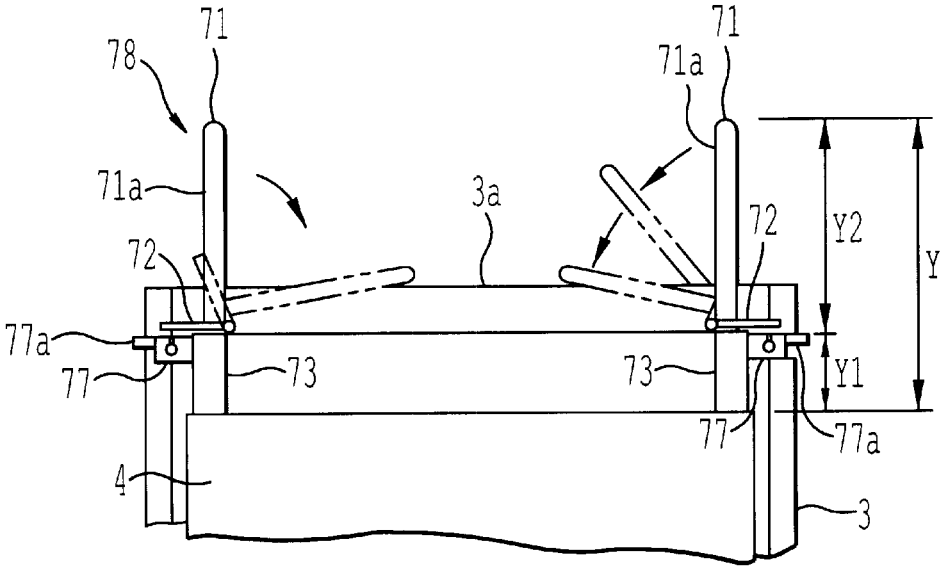
FIG. 11 is a front view showing the railing member in FIG. 10.

FIG. 10 is a perspective view of a railing member 78 of a sixth embodiment of the present invention. FIG. 11 is a front view showing the railing member 78 in FIG. 10.

In this embodiment, at the time of an inspection, to insure safety of a maintenance worker as much as possible, a height of the railing member 78 is composed to be adjustable in height before the maintenance worker steps on the cage 4.

That is, the railing member 78 is composed of a pair of first railing members 70 disposed on the cage 4 along the top side edges thereof so as to be adjustable in height, and a second railing member 75 disposed on the cage 4 along the top back side of thereof so as to be adjustable in height. The first railing members 70 and the second railing member 75 can be raised for inspection before the maintenance worker steps on the cage 4 from an elevator depot.

Each of the first railing members 70 is composed of a railing 71 formed in the shape of an inverted U and extending from the front side of the cage 4 to the back side. The railing 71 has two legs 71*a* mounted on stands 73 on the cage 4 via hinges 72 capable of turning toward the center of the cage 4. Thus, as shown in FIG. 10, the first railing members 70 are installed on the cage 4 so as to stand upright and to fold toward the center of the cage 4 as indicated by double dotted chain lines. The first railing members 70 are folded and lain on top of the cage frame 3*a*.

The second railing member 75 is composed of a chain 76 connected at opposite ends thereof to the back side ends of the railings 71. The chain 76 is disposed between the railings 71 so as to achieve a desired height when the railings 71 stand upright. That is, the chain 76 becomes tight and loose according to up and down movement of the railings 71, thereby changing its height.

Further, ratchets 77 are attached to respective front sides of the hinges 72 supporting the legs 71*a*. The ratchets 77 lock a turning part and a fixed part of the hinges together, thereby maintaining the upright state of the railings 71. Furthermore, knobs 77*a* are respectively provided at the ratchets 77 in order to release the lock state of the ratchets 77. Thus, the railing 71 and the chain 76 can be adjusted to a height suitable for an inspection at the elevator depot without stepping on the cage 4.

According to the sixth embodiment, in case of inspection, the maintenance worker grabs one of the legs 71*a* and stands the railing 71 upright by leaning out of the elevator depot before stepping on the cage 4, and then locks the hinge 72 with the ratchet 77. The other railing 71 is lifted up and locked in the same way, as a result, both sides of the railings 71 are locked and kept in upright state as shown in FIG. 10 and FIG. 11. After the inspection, the maintenance worker first steps out to the elevator depot, then releases the lock state of the ratchets 77 by operating the knobs 77*a,* and folds the railings 71 toward the center of the cage 4. Thus, the height of the railings 71 and the chain 76 can be set to a position ensuring the safety of the maintenance worker before stepping on the cage 4.

Accordingly, the maintenance worker can step on the cage 4 after ensuring the safety, and inspect the elevator in safety.

Further, since the railings 71 are mounted on the stands 73, in case of standing the railings 71 upright, the overall height of the railing member 78 suitable for the safety of the maintenance worker becomes the height Y equal to the sum of the height Y1 of the stands 73 and the height Y2 of the railings 71 as shown in FIG. 11. On the other hand, in case of folding the railings 71, since only the railings 71 are folded, the railing member 78 can be housed in a small space. Furthermore, in case that the height of the railing member 78 is required to change due to a change of the type of the elevator, the same railings 71 can be used though the height of the stands 73 might be changed.

Figure 12B:
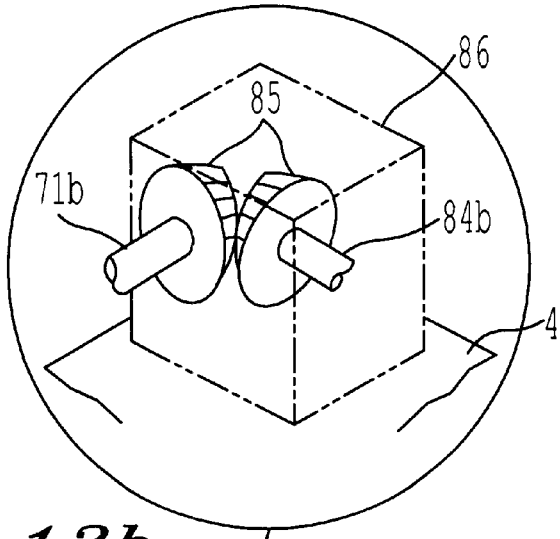
FIG. 12(*a*) is a perspective view of a railing member of a seventh embodiment of the present invention.
Figure 12A:
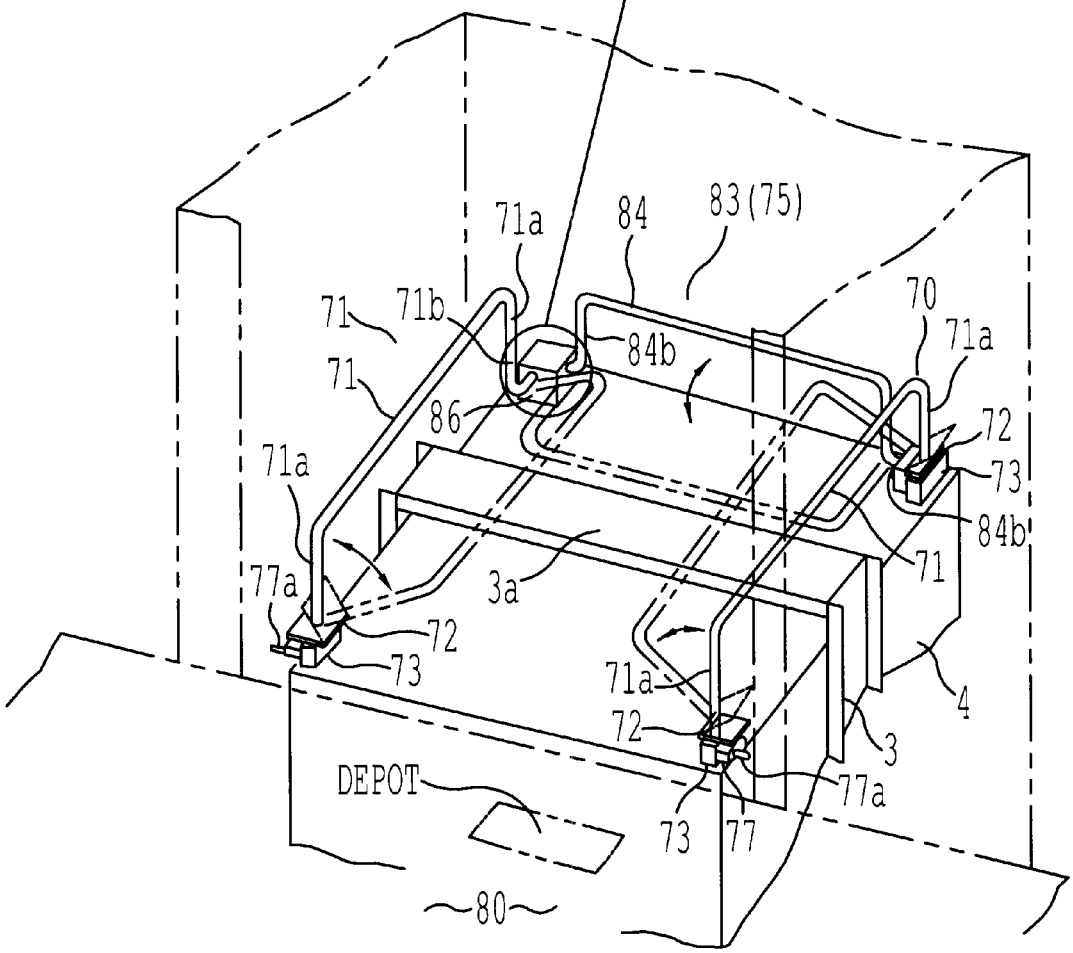

FIG. 12(*a*) is a perspective view of a railing member of a seventh embodiment of the present invention. FIG. 12(*b*) is a perspective view of a principal part of the railing member in FIG. 12(*a*).

This embodiment modifies the sixth embodiment, substituting a folding railing member 83 for the chain 76 as the second railing member 75.

The railing member 83 is composed of a railing 84 formed in the shape of an inverted U. The opposite end portions 84*b* of the railing 84 are formed in a crank, and pivotably supported on the cage 4 by means of a shaft bearing (not shown), thereby enabling the railing 84 to be lifted up to stand upright and to be folded toward the center of the cage 4 as shown in FIG. 12(*a*).

One of the legs 71*a* adjacent to the railing 84 is formed in the same way as the end portion 84*b*. That is, one end portion 71*b* of the legs 71*a* is pivotably supported on the cage 4 as shown in FIG. 12(*b*) by means of a shaft bearing (not shown). The both end portions 84*b* and 71*b* are connected by a gear member 86 composed of two bevel gears 85. Thus, if the railings 71 are folded from their standing upright state, the railing 84 is folded together therewith. On the other hand, if the railings 71 are raised up to the standing upright state, the railing 84 also stands. Only one railing 71 need be manipulated to achieve such operation.

Figure 13A:
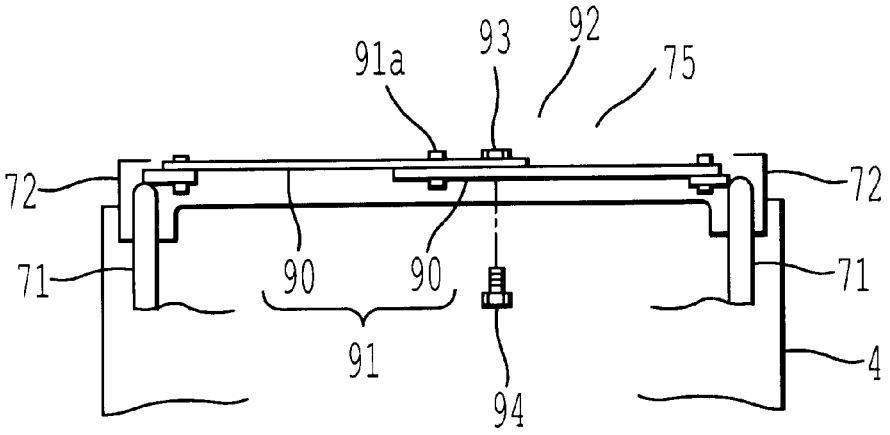
FIG. 13(*a*) is a top view of a railing member of an eighth embodiment of the present invention.
Figure 13B:
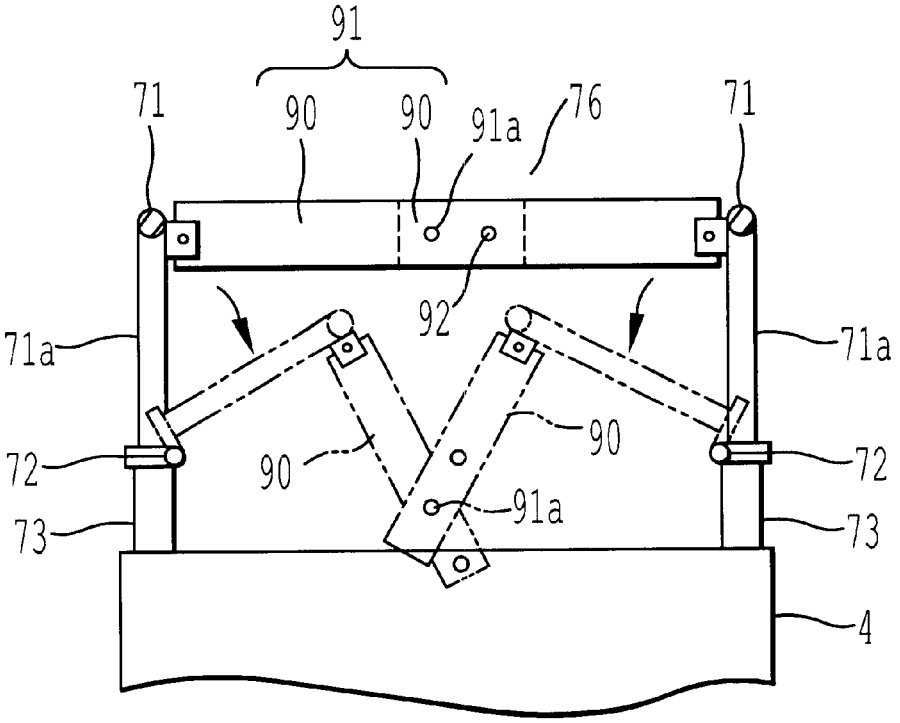

FIG. 13(*a*) is a top view of a railing member of an eighth embodiment of the present invention. FIG. 13(*b*) is a front view of the railing member in FIG. 13(*a*).

This embodiment modifies the sixth embodiment, substituting a link railing member 91 for the chain 76 as the second railing member 75.

The railing member 91 is composed of a pair of railings 90 pivotably connected at one of the ends thereof to respective back side ends of the railings 71, with the other ends thereof connected together. Thus, as shown in FIG. 13(*b*), with folding of the railings 71, the railings 90 are moved downward and folded, turning at the connecting point 91*a*.

Further, a lock device 92 is added to the railing member 91 in order to keep a desired railing position and to disperse and reduce a load to be added to the railings 90.

The lock device 92 is composed of a nut 93 welded on back side of one of the railings 90, and a bolt 94 to be screwed in the nut 93 through a hole (not shown) provided on the other railing 90 in correspondence with the location of the nut 93. The railings 90 are locked in a straight line by means of the nut 93 and the body 94.

Figure 14:
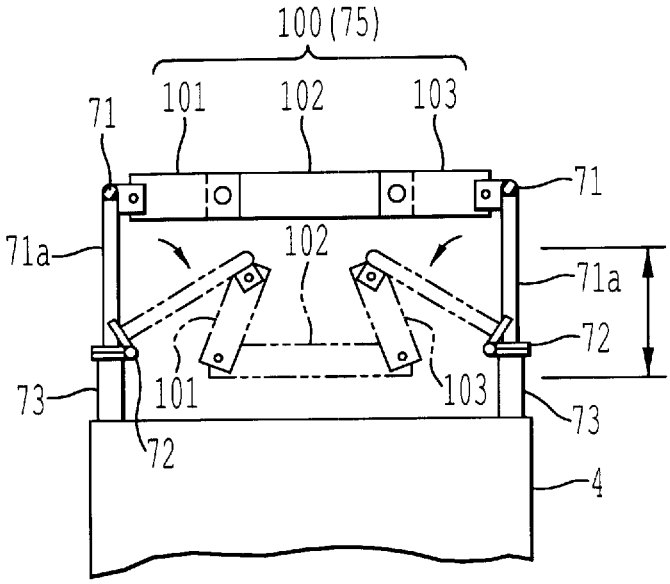
FIG. 14 is a front view of a railing member of a ninth embodiment of the present invention.

FIG. 14 is a front view of a railing member of a ninth embodiment of the present invention.

This embodiment modifies the sixth embodiment, substituting a link railing member 100 for the chain 76 as the second railing member 75.

The railing member 100 is composed of a pair of first railings 101 and 103 pivotably connected at one end of each thereof to respective back side ends of the railings 71, and a parallel railing 102 pivotably connected at opposite ends thereof to respective opposite ends of the first railings 101 and 103. Thus, as shown in FIG. 14, with folding of the railings 71, the railing member 100 is moved downward and folded pivoting on their fulcrums.

According to the ninth embodiment, the entire folded height H of the railing member 100 can be lowered.

Figure 15A:
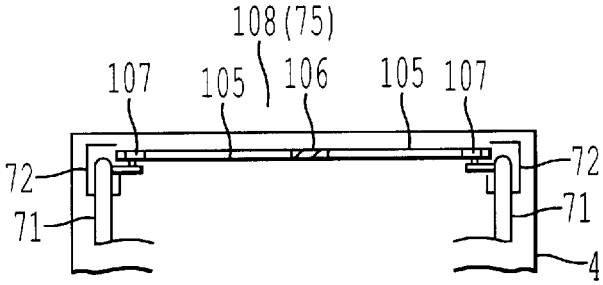
FIG. 15(*a*) is a top view of a railing member of a tenth embodiment of the present invention.
Figure 15B:
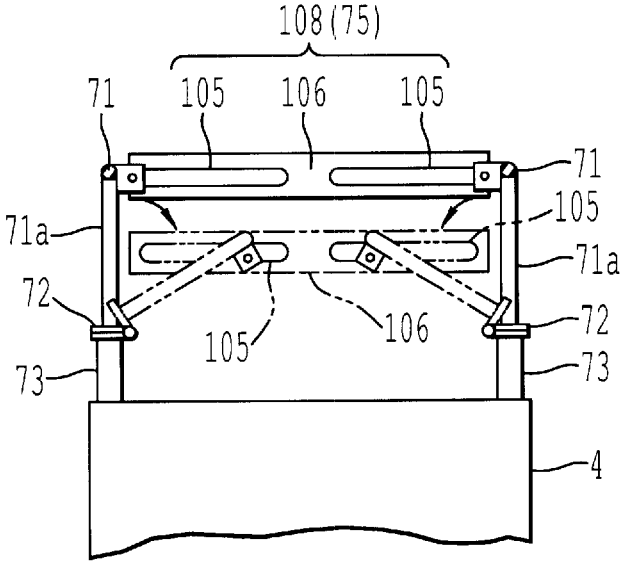

FIG. 15(*a*) is a top view of a railing member of a tenth embodiment of the present invention. FIG. 15(*b*) is a front view of the railing member in FIG. 15(*a*).

This embodiment modifies the sixth embodiment, substituting a slide railing member 108 for the chain 76 as the second railing member 75.

The railing member 108 is composed of a railing 106 having a pair of slit rails 105 extending between the railings 71, and a pair of cam rollers 107 attached to respective back sides of the railings 71 and guided by the rails 105. Thus, as shown in FIG. 15(*b*), with folding of the railings 71, the railing member 108 is moved downward and folded, being guided by the cam rollers 107 and the slit rails 105.

The slit rails 105 can be substituted for a guide rail attached to a side of the railing 106 without a slit.

Figure 16:
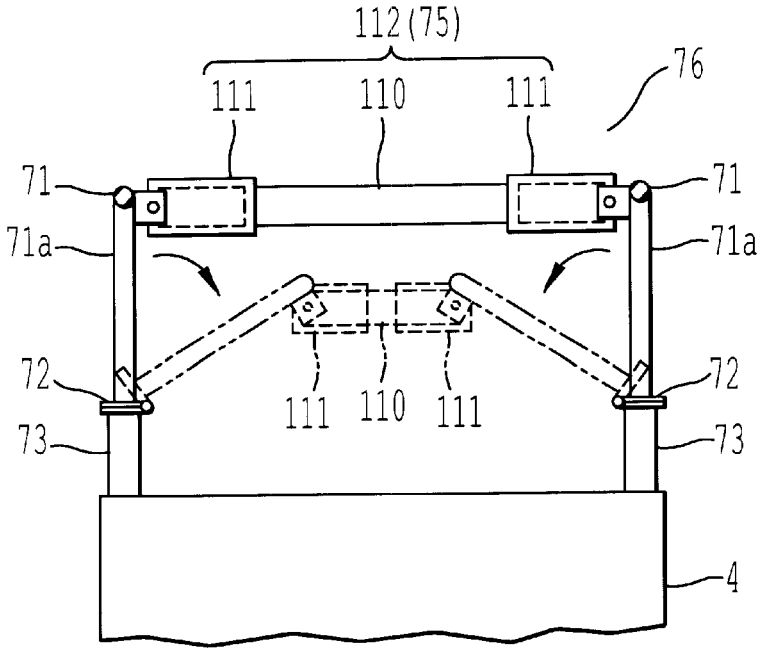
FIG. 16 is a front view of a railing member of an eleventh embodiment of the present invention.

FIG. 16 is a front view of a railing member of an eleventh embodiment of the present invention.

This embodiment modifies the sixth embodiment, substituting an elastic railing member 112 for the chain 76 as the second railing member 75.

The railing member 112 is composed of a pair of cylinders 111 each pivotably connected at one end thereof to respective back sides of the railings 71, and an elastic member 110 connected at opposite ends thereof to inside of the cylinders 111. Thus, as shown in FIG. 16, with folding of the railings 71, the railing member 112 is moved downward, and the elastic member 110 is contracted.

Figure 17:
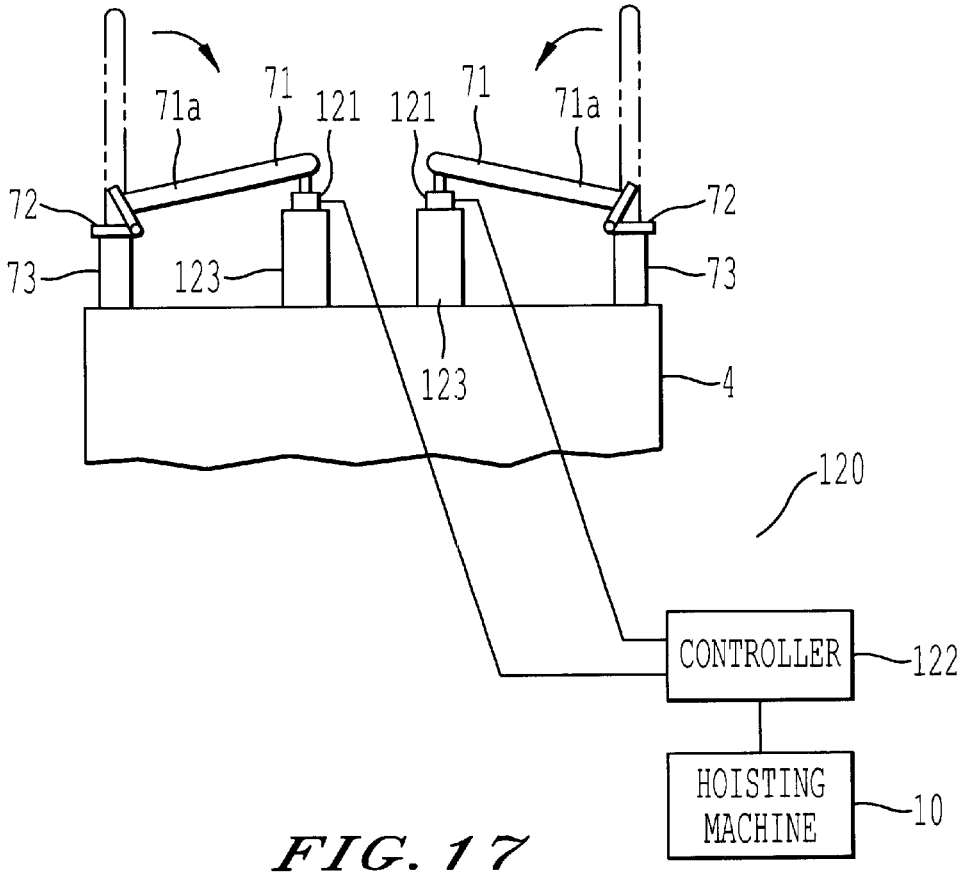
FIG. 17 is a front view of a railing member of a twelfth embodiment of the present invention.

FIG. 17 is a front view of a railing member of a twelfth embodiment of the present invention.

This embodiment modifies the sixth embodiment in FIG. 10, adding an operation prohibiting device 120, which prohibits a normal operation of the elevator until the railings 71 return to a position lower than the highest object on the cage 4, to the sixth embodiment.

The operation prohibiting device 120 is composed of two limit switches 121 mounted on the cage 4 via stands 123 for detecting whether the railings 71 return to a proper position, and a controller 122. The limit switches 121 output confirmation signals to the controller 122 at the time the railings 71 return to a proper position for a normal operation of the elevator. The controller 122 outputs a permit signal to the hoisting machine 10 only upon receiving both confirmation signals from each limit switch 121 in order to allow a normal operation of the elevator. That is, the elevator can not be operated until the railings 71 return to a position lower than the highest object on the cage 4.

Figure 18:
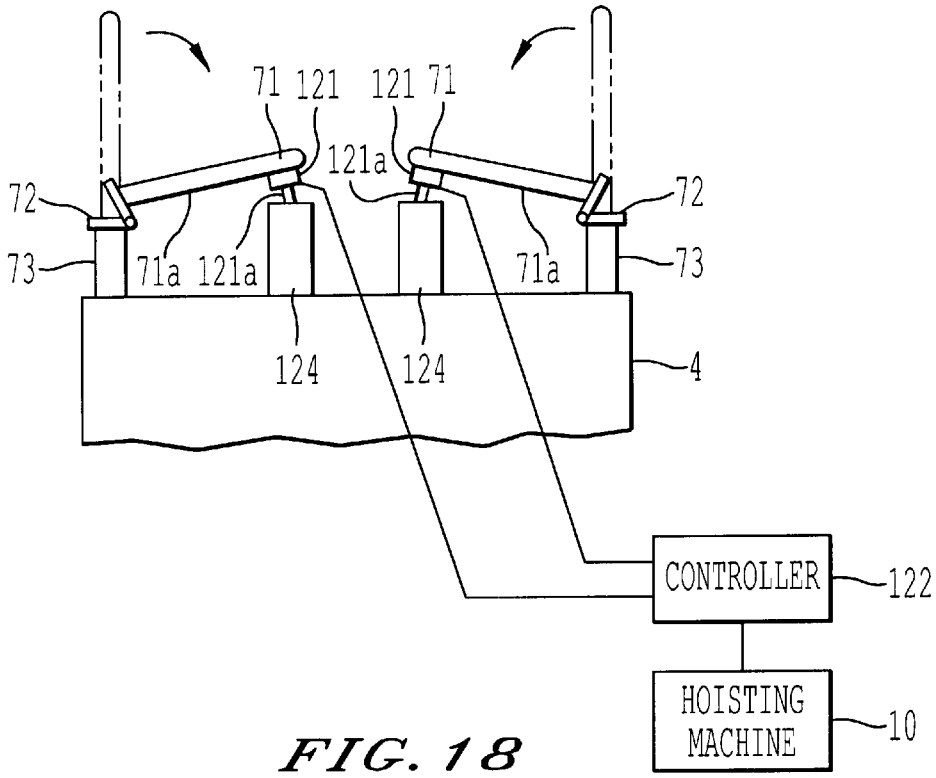
FIG. 18 is a front view of a railing member of a thirteenth embodiment of the present invention.

FIG. 18 is a front view of a railing member of a thirteenth embodiment of the present invention.

This embodiment modifies the twelfth embodiment of FIG. 17, by mounting the limit switches 121 on the railings 71. That is, the projections 121*a* of the limit switches 121 are mounted on respective of the railings 71 such that the projections 121*a* contact stands 124 at the time the railings 71 fold down.

According to the thirteenth embodiment, similarly the elevator can not be operated until the railings 71 return to a position lower than the highest object on the cage 4.

Figure 19:
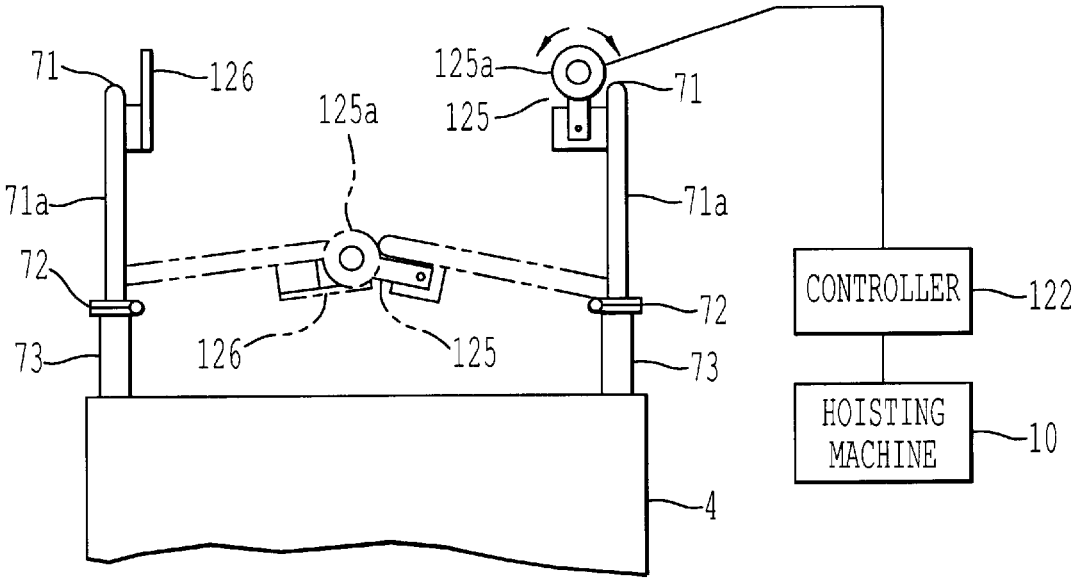
FIG. 19 is a front view of a railing member of a fourteenth embodiment of the present invention.

FIG. 19 is a front view of a railing member of a fourteenth embodiment of the present invention.

This embodiment modifies the twelfth embodiment in FIG. 17, substituting a switch device 125 for the limit switches 121.

The switch device 125 is composed of a turning switch 125*a* installed on an upper side of one of the railings 71, and a plate 126 attached on an upper side of the other railing 71 for switching on and off the turning switch 125*a* by contacting the turning switch 125*a*. Thus, only when both railings 71 are folded properly, will the turning switch 125*a* contact the plate 126, and only then will the switch device 125 output the confirmation signal to the controller 122.

According to the fourteenth embodiment, it is possible to detect whether both railings 71 are folded properly by means of only one switch 125*a*.

Various modifications and variations are possible in light of the above teachings. Therefore, it is to be understood that within the scope of the appended claims, the present invention may be practiced otherwise than as specifically described herein.

What is claimed as new and desired to be Secured by Letters Patent of the United States is:

1. An elevator comprising:

a cage configured to ascend and descend in an elevator shaft;

at least one stand provided on a top of the cage; and at least one railing member mounted on the at least one stand through a hinge and configured to be adjustable in height by being folded at the hinge toward a center of the cage and to stand upright, wherein said at least one railing member comprises:

a pair of first railing members each including a folding railing and disposed on said cage along opposite first and second side edges of said cage, and a second railing member disposed on said cage along a third side edge of said cage, said pair of first railing members configured to raise up causing said second railing member to also raise up;

said first railing members and said second railing member configured to be set at a desired position before a maintenance worker stands on said cage.

2. the elevator as recited in claim 1, further comprising:

a connecting member configured to intergrate adjacent of said first and second railing members.

3. The elevator as recited in claim 1, further comprising:

a lock member configured to lock one of said first railing members at a desired position, said first railing members being connected with said second railing member so as to be set at said desired position in unison.

4. The elevator as recited in claim 3, wherein:

said second railing member comprises a chain member.

5. The elevator as recited in claim 3, wherein:

said second railing member comprises a folding railing.

6. The elevator as recited in claim 3, wherein said second railing member comprises:

a pair of first plates each pivotably connected at one end thereof to respective back side ends of said first railing members, and a parallel plate pivotably connected at opposite ends thereof to respective other ends of said first plates, said first plates and said parallel plate configured such that, with the folding of said first railing members, said parallel plate moves downward.

7. The elevator as recited in claim 3, wherein said second railing member comprises:

a pair of cams attached to respective back side ends of respective of said first railing members, and plate extending between said first railing members and having at least one split rail configured to guide said cams, said plate and said cams configured such that with the folding of said first railing member, said plate moves downward.

8. The elevator as recited in claim 3, wherein said second railing member comprises:

an elastic member having opposite ends connected to respective back side ends of said first railing members, said elastic member configured to expand and contract such that with the folding of said first railing members, said elastic member moves downward.

9. The elevator as recited in claim 1, further comprising:

means for prohibiting a normal operation of said cage as long as said railing is not positioned lower than a highest protruded object on said cage.

10. An elevator comprising:

a cage configured to ascend and descend in an elevator shaft; and at least one railing member disposed on said cage along a top edge of the cage and configured to be adjustable in height, wherein said at least one railing member comprises:

a pair of first railing members each including a folding railing and disposed on said cage along the opposite top side edges thereof, and a second railing member disposed on said cage along the top back side edge thereof, said first railing members and said second railing member configured to be set at a desired position before a maintenance worker stands on said cage;

the elevator further comprising:

a lock member configured to lock one of said first railing members at a desired position, said first railing members being connected with said second railing member so as to be set at said desired position in unison; and wherein said second railing member comprises:

a pair of levers each pivotably connected at one end thereof to respective back side ends of said first railing members, and connected together at other ends thereof, said pair of levers configured such that with the folding of said first railing member, said other ends turn downward.

* * * * *